US008429868B2

(12) United States Patent
Minami

(10) Patent No.: US 8,429,868 B2
(45) Date of Patent: Apr. 30, 2013

(54) LATERAL DISPLACEMENT PREVENTING MEMBER FOR EXTERIOR WALL BOARD AND EXTERIOR WALL INSTALLATION STRUCTURE USING THE SAME

(75) Inventor: Gou Minami, Mie-gun (JP)

(73) Assignee: Nichiha Corporation, Nagoya-Shi (JP)

( * ) Notice: Subject to any disclaimer, the term of this patent is extended or adjusted under 35 U.S.C. 154(b) by 0 days.

(21) Appl. No.: 13/534,047

(22) Filed: Jun. 27, 2012

(65) Prior Publication Data

US 2013/0000238 A1 Jan. 3, 2013

(30) Foreign Application Priority Data

Jun. 28, 2011 (JP) ..... 2011-142445

(51) Int. Cl.
*E04B 2/28* (2006.01)

(52) U.S. Cl.
USPC ..... 52/506.05; 52/520; 52/235

(58) Field of Classification Search ..... 52/235, 52/520, 544, 551, 506.05, 509, 543
See application file for complete search history.

(56) References Cited

U.S. PATENT DOCUMENTS

| | | | | |
|---|---|---|---|---|
| 3,342,005 | A * | 9/1967 | Rickards et al. | 52/702 |
| 3,469,866 | A * | 9/1969 | Ashby et al. | 52/509 |
| 4,825,617 | A * | 5/1989 | Kinoshita et al. | 52/396.01 |
| 5,664,392 | A * | 9/1997 | Mucha | 52/715 |
| 6,266,937 | B1 * | 7/2001 | Watanabe | 52/489.2 |
| 6,499,261 | B2 * | 12/2002 | Hikai | 52/235 |
| 6,609,342 | B2 * | 8/2003 | Hikai | 52/506.01 |
| 7,174,690 | B2 * | 2/2007 | Zadeh | 52/715 |
| 7,748,188 | B2 * | 7/2010 | Ito | 52/506.06 |
| 8,322,103 | B1 * | 12/2012 | Kownacki | 52/506.05 |
| 2002/0046536 | A1 * | 4/2002 | Hotta | 52/698 |
| 2002/0046546 | A1 * | 4/2002 | Ito | 52/802.11 |
| 2002/0095889 | A1 * | 7/2002 | Hikai | 52/235 |
| 2006/0032173 | A1 * | 2/2006 | Hikai | 52/506.05 |

FOREIGN PATENT DOCUMENTS

| | | | | |
|---|---|---|---|---|
| JO | 2004-270341 | A | | 9/2004 |
| JP | 2000-291225 | A | | 10/2000 |
| JP | 2001-355325 | A | | 12/2001 |
| JP | 2001355325 | A | * | 12/2001 |
| JP | 2002-81186 | A | | 3/2002 |
| JP | 2002081186 | A | * | 3/2002 |
| JP | 2004270341 | A | * | 9/2004 |
| JP | 2005-282198 | A | | 10/2005 |
| JP | 2005282198 | A | * | 10/2005 |
| JP | 2006-37567 | A | | 2/2006 |
| JP | 2006037567 | A | * | 2/2006 |

* cited by examiner

*Primary Examiner* — Christine T Cajilig
(74) *Attorney, Agent, or Firm* — Birch, Stewart, Kolasch & Birch, LLP

(57) ABSTRACT

A lateral displacement preventing member is provided with a back-side locking piece that extends from a lower end of an upper fixing plate of the lateral displacement preventing member downward and parallel to a lower fixing plate. Thus, during disposition of the lateral displacement preventing member in a horizontal joint portion of exterior wall boards, the lateral displacement preventing member can be attached in a state in which an upper end portion of an upper horizontal portion of a first fastening member disposed in a vertical joint portion of the exterior wall boards is inserted in an inverted U-shaped groove formed by the back-side locking piece, an extended portion, and the lower fixing plate of the lateral displacement preventing member.

5 Claims, 14 Drawing Sheets

LATERAL DISPLACEMENT PREVENTING MEMBER FOR EXTERIOR WALL BOARD AND EXTERIOR WALL INSTALLATION STRUCTURE USING THE SAME

BACKGROUND OF THE INVENTION

1. Field of the Invention

The present invention relates to a lateral displacement preventing member for preventing lateral displacement of exterior wall boards that are joined together by shiplap joint on four sides and arranged, as well as an exterior wall installation structure using the lateral displacement preventing member.

2. Description of the Related Art

Conventionally, as shown in FIG. 11, there has been an exterior wall installation structure 209 in which a plurality of exterior wall boards 204 each having an upper underlying rabbeted portion 211, a lower overlying rabbeted portion 221, a lateral underlying rabbeted portion 231, and a lateral overlying rabbeted portion are fastened to a structural building frame 292 while being joined together by shiplap joint on four sides.

In the exterior wall installation structure 209, exterior wall boards 204 are fastened to the structural building frame 292 by fastening members 295 each disposed in a vertical and horizontal joint portion of four vertically and horizontally adjacent exterior wall boards 204.

However, although each of the fastening members 295 locks an upper end portion and a lower end portion of the exterior wall boards 204, the fastening member 295 cannot particularly restrict horizontal movement of the exterior wall boards 204.

Thus, there has been a risk that horizontal displacement of the exterior wall boards 204 may lower exterior design quality of the exterior wall installation structure 209 or create a gap between horizontally adjacent exterior wall boards, leading to intrusion of rainwater.

To address this issue, although not shown, technologies in which a lateral displacement preventing means for preventing lateral displacement of exterior wall boards is provided in a fastening member or provided in a seal member that is used in a state in which it is placed over the fastening member are disclosed in JP 2001-355325A and JP 2002-81186A.

However, the above-described conventional technologies are technologies that seek to even add a lateral displacement preventing function to a single member in addition to a fastening function or a leakage preventing function, and thus the shape of the member is complicated, resulting in the problem of increased manufacturing costs.

Moreover, since it is necessary to dispose the fastening member, the seal member, or the like in a designated position in order to allow such members to sufficiently exhibit the functions, in some cases, installation was not necessarily easy.

An installation structure shown in FIG. 12 is known as an exterior wall installation structure that can prevent lateral displacement of exterior wall boards that are fastened to a metal backing frame while being joined together by shiplap joint on four sides, and that thus decreases installation costs and facilitates installation.

According to the installation structure shown in FIG. 12, in installation of exterior wall boards 204, which are fastened to a metal backing frame 202 by a fastening member (not shown) disposed at an upper end portion 241 and a lower end portion 242 of the exterior wall boards 204, a lateral displacement preventing member 206 for preventing lateral displacement of the exterior wall boards 204 is disposed in a vertical and horizontal joint portion 248 of the exterior wall boards 204.

This lateral displacement preventing member 206 has a flat-plate like fixing plate portion 261 and an abutment plate portion 262 that is provided upright at approximately right angles to the fixing plate portion 261.

The fixing plate portion 261 of the lateral displacement preventing member 206 is fixed to the metal backing frame 202 with screws 213 while the abutment plate portion 262 abuts on side end faces 232 of the exterior wall boards 204. (JP 2005-282198A)

JP 2004-270341A discloses a fastening member having excellent durability that can fasten, at a sufficient strength, exterior wall boards whose horizontal joint portion is disposed in an area where no vertical member is provided, an exterior wall installation structure using this fastening member, and an exterior wall installation method.

The effect of the invention disclosed in JP 2004-270341A is that, as shown in FIG. 13, a fastening member 101 is composed of a long fixing plate 102 and a slide fastening member 103, and even when a horizontal joint portion 140 of exterior wall boards is not disposed on a vertical member 151, the slide fastening member 103 can be disposed in the horizontal joint portion 140.

Then, the horizontal joint portion 140 of the exterior wall boards can be fixed to a structural building frame 150 by the slide fastening member 103 via the long fixing plate 102. Accordingly, the fastening member 101 can fasten, at a sufficient strength, the exterior wall boards 104 whose horizontal joint portion 140 is disposed in an area where no vertical member 151 is provided.

Meanwhile, it is the slide fastening member 103 that locks the exterior wall boards 104 in the horizontal joint portion 140. Moreover, the slide fastening member 103 is not particularly long, and therefore the slide fastening member 103 is not subjected to a great load even if acted upon by forces in different directions from the horizontally adjacent exterior wall boards 104.

A fastening member 301 disclosed in JP 2006-037567A has, as shown in FIG. 14, a long fixing plate portion 311 that is fixed to at least one vertical member and a first fastening portion 312 that is provided on the long fixing plate portion 311.

Thus, the long fixing plate portion 311 can be reliably fixed to a vertical member in a state in which the first fastening portion 312 is disposed in a horizontal joint portion of exterior wall boards. Therefore, even in the case where a horizontal joint portion of exterior wall boards is disposed in an area where no vertical member is provided, the exterior wall boards can be fastened to a structural building frame at a sufficient strength by the long fixing plate portion 311 of the fastening member 301 being reliably fixed to a vertical member. Accordingly, when the first fastening portion 312 is disposed in the horizontal joint portion of the exterior wall boards, the long fixing plate portion 311 can be fixed to any vertical member irrespective of the position of the horizontal joint portion, and therefore installation is easy.

Moreover, the fastening member 301 has a second fastening portion 314, and therefore, horizontally adjacent exterior wall boards can be reliably horizontally fastened by causing the second fastening portion 314 together with the first fastening portion 312 to lock the exterior wall boards.

Moreover, the fastening member 301 has a vertical upright portion 313. Therefore, even in the case where the horizontal joint portion is disposed in an area where no vertical member is provided, the fastening member 301 can be fixed to the structural building frame in a state in which the vertical upright portion 313 abuts on the side end faces of the exterior wall boards, and thus horizontal displacement of the exterior wall boards can be prevented.

SUMMARY OF THE INVENTION

With regard to a member for fastening exterior wall boards for shiplap joint on four sides to a backing material and an installation structure using this member or a lateral displacement preventing member for exterior wall boards for shiplap joint on four sides and an installation structure using this member as disclosed by conventional technologies, there have been the problems in that a measure to prevent lateral displacement is not taken, the lateral displacement preventing member is integrated with the fastening member and the shape of the combined member is complicated, a backing is inevitably required in the position of the lateral displacement preventing member because the lateral displacement preventing member is directly fastened to the backing, or although not restricted by the position of the backing, the member obtained by combining the long fixing plate, the fastening member, and the lateral displacement preventing member has a very large and complicated shape for a lateral displacement preventing member.

The present invention has been made in view of conventional problems such as those described above, and it is an object thereof to provide a lateral displacement preventing member for preventing lateral displacement of exterior wall boards that are fastened to a metal backing frame while being joined together by shiplap joint on four sides, the lateral displacement preventing member having a simple shape and providing increased ease of installation, and furthermore, an exterior wall installation structure that facilitates installation.

In order to solve the problems, a lateral displacement preventing member according to a first aspect of the present invention is a lateral displacement preventing member that can be disposed in a horizontal joint portion of exterior wall boards that are fastened to an angular corrugated metal backing material while being joined together by shiplap joint on four sides and that is used to prevent lateral displacement of the exterior wall boards, the lateral displacement preventing member including:

a flat plate-like upper fixing plate;

an upper abutment plate that is provided upright at approximately right angles to the upper fixing plate;

a lower fixing plate that is extended from a lower end of the upper fixing plate and disposed approximately parallel to the upper fixing plate in a position forward of the upper fixing plate; and a lower abutment plate that is provided upright at approximately right angles to the lower fixing plate, wherein a back-side locking piece that extends from the lower end of the upper fixing plate downward and parallel to the lower fixing plate is provided, and when the lateral displacement preventing member is disposed in the horizontal joint portion, an upper horizontal portion of a first fastening member that is disposed in a vertical joint portion of the exterior wall boards is inserted between the back-side locking piece and the lower fixing plate.

Since the back-side locking piece that extends from the lower end of the upper fixing plate downward and parallel to the lower fixing plate is provided as described above, when disposing the lateral displacement preventing member in the horizontal joint portion of the exterior wall boards, the lateral displacement preventing member can be attached in a state in which an upper end portion of the upper horizontal portion of the first fastening member disposed in the vertical joint portion of the exterior wall boards is inserted in an inverted U-shaped groove formed by the back-side locking piece, an extended portion, and the lower fixing plate of the lateral displacement preventing member.

Therefore, the lateral displacement preventing member can be freely disposed irrespective of the presence or absence of a backing material, and even when a horizontal joint portion of exterior wall boards that are fastened to an angular corrugated metal backing material while being joined together by shiplap joint on four sides is disposed in a position at which no backing is provided, the lateral displacement preventing member can be freely attached.

Moreover, according to a second aspect of the present invention, in addition to the above-described configuration, a plurality of upper screw holes are formed in the upper fixing plate in a horizontal direction, a plurality of lower screw holes are formed in the lower fixing plate in the horizontal direction, and arrangement intervals of the upper screw holes and of the lower screw holes in the horizontal direction are shorter than a length, in a width direction, of a ridge portion on an exterior side of the angular corrugated metal backing material on which the upper fixing plate abuts.

According to the second aspect, screws for fixing the lateral displacement preventing member do not overlap an inclined portion of the angular corrugated metal backing material, and therefore, screws for fixing the lateral displacement preventing member can be fixed to the first fastening member or the ridge portion on the exterior side of the angular corrugated metal backing material at two positions that are not on the same perpendicular line using the upper screw holes or the lower screw holes.

An exterior wall installation structure according to a third aspect of the present invention is an exterior wall installation structure in which a plurality of exterior wall boards each having an upper underlying rabbeted portion, a lower overlying rabbeted portion, a lateral underlying rabbeted portion, and a lateral overlying rabbeted portion are fastened to an angular corrugated metal backing material while being joined together by shiplap joint on four sides, wherein the exterior wall boards are fastened to the angular corrugated metal backing material by a first fastening member disposed at an upper end portion and a lower end portion of the exterior wall boards, the first fastening member includes an upper horizontal portion that forms a fixing surface to be fixed to the angular corrugated metal backing material, a flat plate portion that protrudes forward from the upper horizontal portion, a support portion that is provided upright across the entire lateral width of the flat plate portion so as to extend in a direction orthogonal to the flat plate portion, an upper locking piece that is bent obliquely upward from the support portion, and a lower locking piece that is bent obliquely downward from the support portion, the upper end portion of an exterior wall board that is disposed on a lower side is locked by the lower locking piece, the lower end portion of an exterior wall board that is disposed on an upper side is supported by the support portion and locked by the upper locking piece, and the upper horizontal portion is fixed to the angular corrugated metal backing material by a fixing member, a lateral displacement preventing member for preventing lateral displacement of the exterior wall boards is disposed in a horizontal joint portion of the exterior wall boards, the lateral displacement preventing member includes a flat plate-like upper fixing plate, an upper abutment plate that is provided upright at approximately right angles to the upper fixing plate, a lower fixing plate that is extended from a lower end of the upper fixing plate and disposed approximately parallel to the upper fixing plate in a position forward of the upper fixing plate, a lower abutment plate that is provided upright at approximately right angles to the lower fixing plate, and a back-side locking piece that extends from the lower end of the upper fixing plate downward and parallel to the lower fixing plate, and the lower fixing plate is fixed to the first fastening member with a fixing member while the upper abutment plate and the lower abutment plate abut on a side end face of the exterior wall boards in a state in which the upper horizontal portion of the first fastening member is inserted between the back-side locking piece and the lower fixing plate.

Since the back-side locking piece that extends from the lower end of the upper fixing plate downward and parallel to the lower fixing plate is provided as described above, when disposing the lateral displacement preventing member in a horizontal joint portion of exterior wall boards, the lateral displacement preventing member can be attached in a state in which an upper end portion of the upper horizontal portion of the first fastening member disposed in the vertical joint portion of the exterior wall boards is inserted in an inverted U-shaped groove formed by the back-side locking piece, an extended portion, and the lower fixing plate of the lateral displacement preventing member. Therefore, the lateral displacement preventing member can be freely disposed irrespective of the presence or absence of a backing material.

Accordingly, even when a horizontal joint portion of exterior wall boards that are fastened to an angular corrugated metal backing material while being joined together by shiplap joint on four sides is disposed in a position at which no backing is provided, the lateral displacement preventing member can be freely attached.

Moreover, according to a fourth aspect of the present invention, in addition to the above-described configuration, in the lateral displacement preventing member, a plurality of upper screw holes are formed in the upper fixing plate in a horizontal direction, a plurality of lower screw holes are formed in the lower fixing plate in the horizontal direction, and arrangement intervals of the upper screw holes and of the lower screw holes in the horizontal direction are shorter than a length, in a width direction, of a ridge portion on an exterior side of the angular corrugated metal backing material on which the upper fixing plate abuts.

According to this aspect, screws for fixing the lateral displacement preventing member do not overlap an inclined portion of the angular corrugated metal backing material, and therefore, screws for fixing the lateral displacement preventing member can be fixed to the first fastening member or the ridge portion on the exterior side of the angular corrugated metal backing material at two positions that are not on the same perpendicular line using the upper screw holes or the lower screw holes.

Moreover, according to a fifth aspect of the present invention, in addition to the configuration of the fourth aspect, the upper fixing plate is fixed to the angular corrugated metal backing material by one or more fixing members inserted through corresponding one or more of the upper screw holes.

According to the present invention, since the back-side locking piece that extends from the lower end of the upper fixing plate downward and parallel to the lower fixing plate is provided, when disposing the lateral displacement preventing member in a horizontal joint portion of exterior wall boards, the lateral displacement preventing member can be attached in a state in which the upper end portion of the upper horizontal portion of the first fastening member disposed in the vertical joint portion of the exterior wall boards is inserted in the inverted U-shaped groove formed by the back-side locking piece, the extended portion, and the lower fixing plate of the lateral displacement preventing member. Therefore, the lateral displacement preventing member can be freely disposed irrespective of the presence or absence of a backing material.

Therefore, even when a horizontal joint portion of exterior wall boards that are fastened to an angular corrugated metal backing material while being joined together by shiplap joint on four sides is disposed in a position at which no backing is provided, the lateral displacement preventing member can be freely attached.

Since screws for fixing the lateral displacement preventing member do not overlap the inclined portion of the angular corrugated metal backing material, screws for fixing the lateral displacement preventing member can be fixed to the first fastening member or the ridge portion on the exterior side of the angular corrugated metal backing material at two positions that are not on the same perpendicular line using the upper screw holes or the lower screw holes.

Accordingly, the first fastening member for fixing the exterior wall boards can be fixed to the metal backing, and furthermore, the lateral displacement preventing member that prevents lateral displacement can be freely fixed, so that it is possible to prevent lateral displacement of exterior wall boards for shiplap joint on four sides that are fastened to the metal backing without limiting the dimension module for exterior wall boards, the intervals between sheathing strips serving as backings, or the arrangement pitch of a backing frame.

DESCRIPTION OF THE PREFERRED EMBODIMENTS

Hereinafter, an embodiment of the present invention will be described.

First Embodiment

Figure 3:
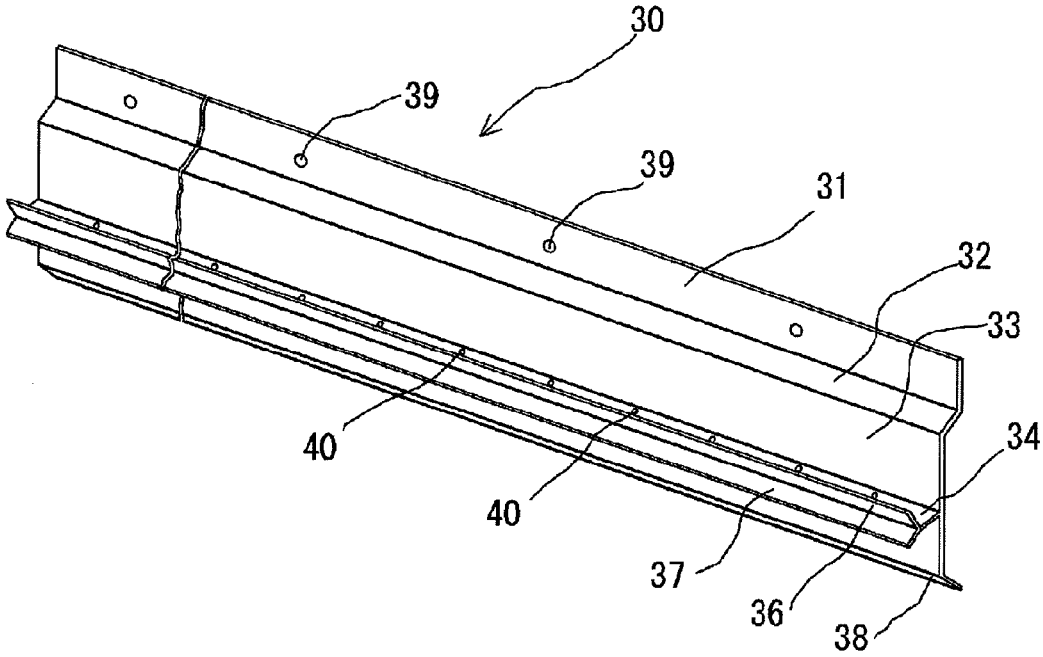
FIG. 3 is a perspective view illustrating the first fastening member.
Figure 4:
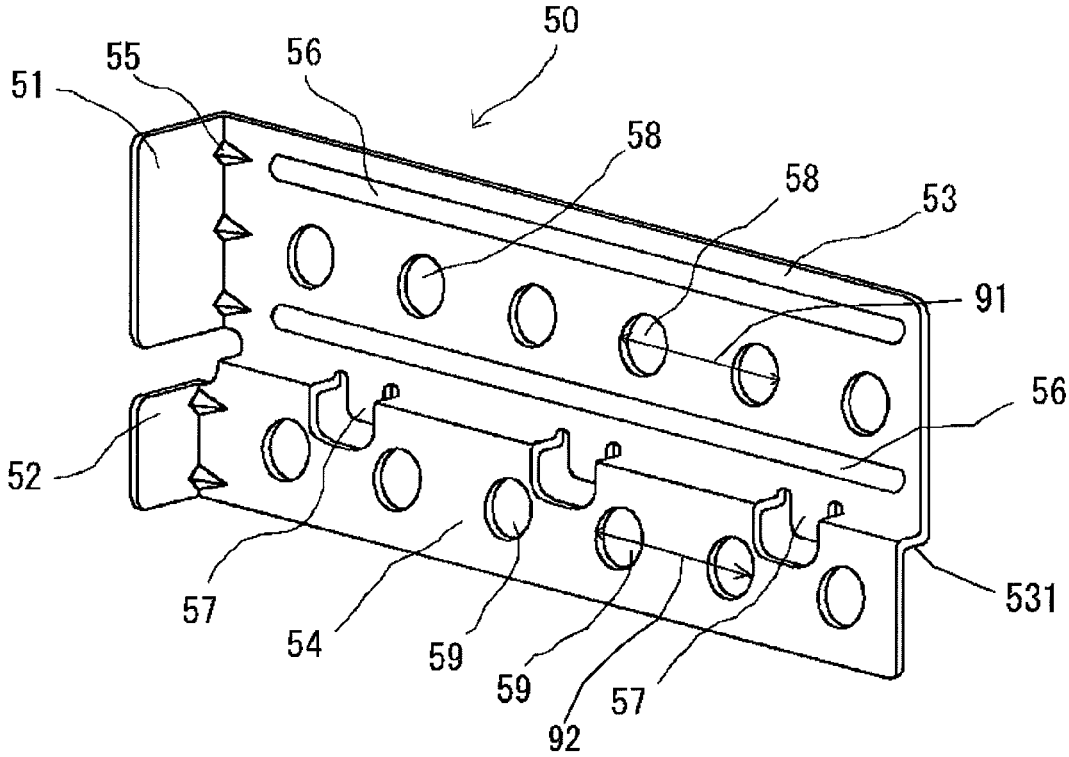
FIG. 4 is a perspective view illustrating the lateral displacement preventing member.

FIG. 4 shows an example of a lateral displacement preventing member 50 according to the present invention, and the lateral displacement preventing member 50 is formed by performing bending and press working of a metal sheet such as a steel sheet. FIG. 3 shows an example of a first fastening member 30, and FIG. 2 is a diagram illustrating a relationship between the first fastening member 30 and the lateral displacement preventing member 50 that are disposed in a vertical and horizontal joint portion 83 of exterior wall boards 4.

In FIG. 4, the lateral displacement preventing member 50 includes a flat plate-like upper fixing plate 53, an upper abutment plate 51 that is provided upright so as to extend forward from an end of the upper fixing plate 53 at approximately right angles to the upper fixing plate 53, a lower fixing plate 54 that is extended forward from a lower end of the upper fixing plate 53 and then, in a position forward of the upper fixing plate 53, extends downward and approximately parallel to the upper fixing plate 53, and a lower abutment plate 52 that is provided upright so as to extend forward, that is, on the side on which the upper abutment plate 51 is provided upright, from an end of the lower fixing plate 54 at approximately right angles to the lower fixing plate 54, and a back-side locking piece 57 that extends from the lower end of the upper fixing plate 53 parallel to the lower fixing plate 54 is formed at the lower end of the upper fixing plate 53.

Since the back-side locking piece 57 that extends from the lower end of the upper fixing plate 53 downward and parallel to the lower fixing plate 54 is formed, the back-side locking piece 57, an extended portion 531, and the lower fixing plate 54 together form an inverted U-shaped groove in the lateral displacement preventing member 50.

Figure 2:
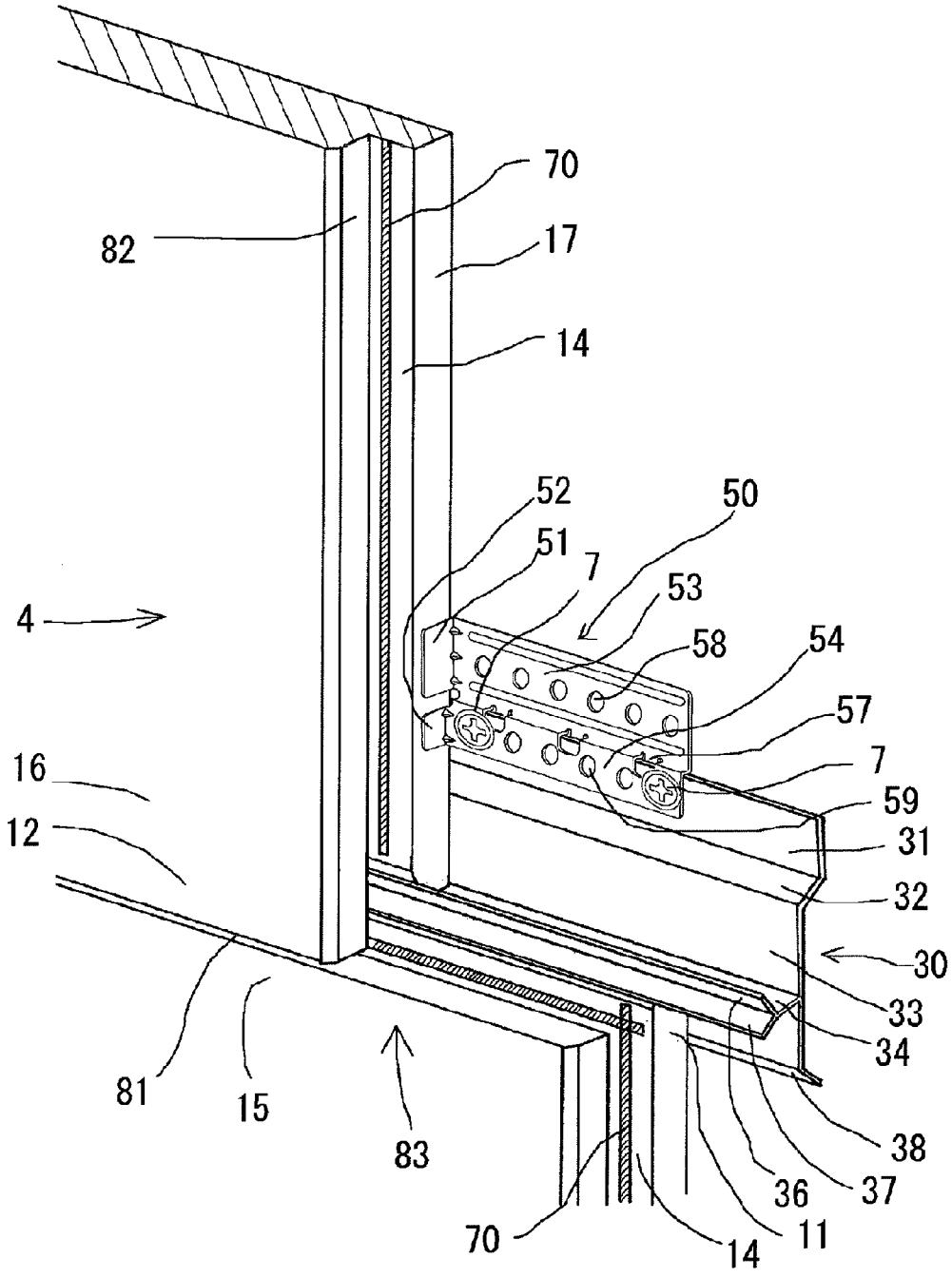
FIG. 2 is a perspective view of a first fastening member and a lateral displacement preventing member disposed in a vertical and horizontal joint portion.

As shown in FIG. 2, when disposing the lateral displacement preventing member 50 in a horizontal joint portion of exterior wall boards 4, the lateral displacement preventing member 50 is attached in a state in which an upper end portion of an upper horizontal portion 31 of the first fastening member 30 disposed in the vertical joint portion of the exterior wall boards 4 is inserted in the inverted U-shaped groove.

Therefore, the distance between the lower fixing plate 54 and the back-side locking piece 57 in the inverted U-shaped groove is slightly wider than the thickness of the upper horizontal portion 31 of the first fastening member 30.

Since the lateral displacement preventing member 50 is used with the upper horizontal portion 31 of the first fastening member 30 inserted therein as described above, an exterior wall board 4 can be pushed in a horizontal direction and positioned by sliding the lateral displacement preventing member 50 in the horizontal direction in a state in which it is mounted on the upper horizontal portion 31 of the first fastening member 30. Accordingly, it is possible to easily bring the upper abutment plate 51 and the lower abutment plate 52 of the lateral displacement preventing member 50 into close contact with a side end face 17 of the exterior wall board 4, and thus positioning of the lateral displacement preventing member 50 is facilitated and the ease of installation is increased.

On the other hand, as shown in FIG. 3, a metal member is used as the first fastening member 30. The first fastening member 30 illustrated in FIG. 3 is a member that is elongated in the horizontal direction, and has the upper horizontal portion 31 whose back surface comes into contact with a backing material, a flat plate portion 33 that comes into contact with a back surface of an exterior wall board, and a support portion 34 that is extended from the flat plate portion 33. An upper locking piece 36 that supports a lower overlying rabbeted portion 12 of an upper exterior wall board and a lower locking piece 37 that supports an upper underlying rabbeted portion 11 of a lower exterior wall board are formed at a front end of the support portion 34. Due to an upwardly extending portion 32 and a downwardly extending portion 38, the flat plate portion 33 protrudes to an exterior side from the backing material side to which an exterior wall is fastened.

It should be noted that it would be preferable if drain holes 40 are formed in the support portion 34 because rainwater that has intruded into the back surface side of an exterior wall board 4 can easily fall downward. Furthermore, it would be preferable if through holes 39 are formed in the upper horizontal portion 31 because attachment of a screw is facilitated in fixing the first fastening member 30 to the exterior wall backing material and thus workability is improved.

In addition, it would be preferable for prevention of deformation of the lateral displacement preventing member 50 if reinforcement ribs 55 are formed between the upper fixing plate 53 and the upper abutment plate 51 and between the lower fixing plate 54 and the lower abutment plate 52 of the lateral displacement preventing member 50. Furthermore, it would be further preferable as a measure to prevent deformation of the upper fixing plate 53 if horizontal ribs 56 are formed in the horizontal direction above and below upper screw holes 58.

It should be noted that it would be preferable if the horizontal ribs 56 are formed so as to protrude on the side on which the upper abutment plate 51 is provided upright because this will allow the back surface of the upper fixing plate 53 to come into close contact with an exterior surface of a ridge portion 61 on the exterior side of an angular corrugated metal backing material 6.

Here, in the lateral displacement preventing member 50, a plurality of upper screw holes 58 are formed in the upper fixing plate 53 in the horizontal direction, and a plurality of lower screw holes 59 are formed in the lower fixing plate 54 in the horizontal direction.

The lateral displacement preventing member 50 is fixed to the first fastening member 30 or the first fastening member 30 and the angular corrugated metal backing material 6 by two or more fixing members 7 via the lower screw holes 59 or the upper screw holes 58 and the lower screw holes 59.

Next, an installation structure according to the first embodiment, in which exterior wall boards 4 are installed to the angular corrugated metal backing material 6 with the lateral displacement preventing member 50 and the first fastening member 30, will be described.

Figure 1:
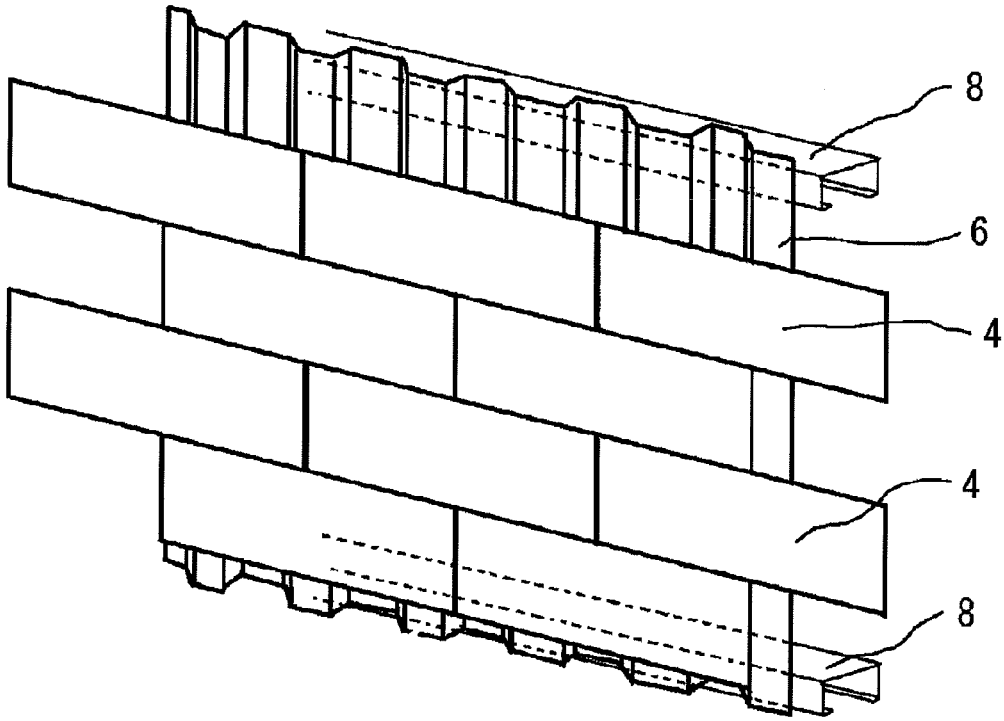
FIG. 1 is a diagram illustrating a state in which exterior wall boards are attached to an angular corrugated metal backing material.

FIG. 1 is a diagram showing a state in which exterior wall boards 4 are attached to the angular corrugated metal backing material 6.

FIG. 2 is a diagram showing an installed state of the first fastening member 30 and the lateral displacement preventing member 50 that are disposed in the vertical and horizontal joint portion 83 of exterior wall boards 4.

Figure 5:
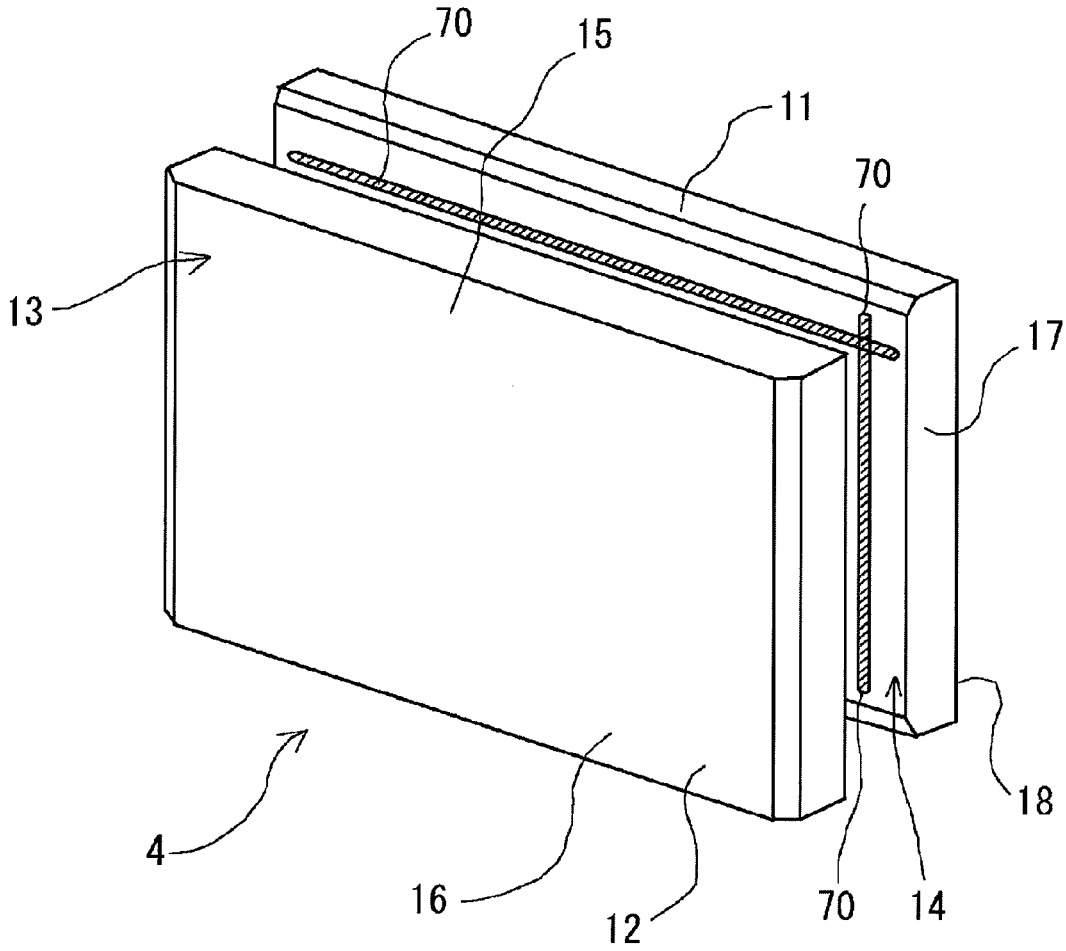
FIG. 5 is a perspective view showing a form of an exterior wall board according to the present invention.

FIG. 5 shows an example of an exterior wall board 4 that is used in the first embodiment.

Figure 6:
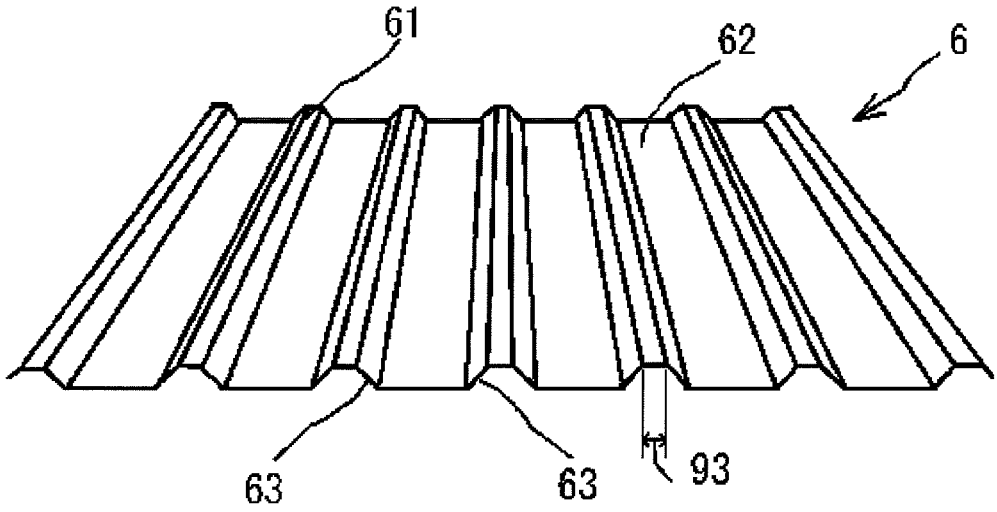
FIG. 6 is a diagram illustrating the shape of an angular corrugated metal backing material.

FIG. 6 shows an example of the angular corrugated metal backing material 6 that is used in the first embodiment, in which the top of the ridge portions 61 on the exterior side and the bottom of trough portions 62 on an interior side are formed as flat surfaces.

As shown in FIG. 1, in the installation structure according to the first embodiment, installation is performed such that ridges and troughs formed by the ridge portions 61 on the exterior side and the trough portions 62 on the interior side of the angular corrugated metal backing material 6 are successively arranged in the horizontal direction. In addition, installation is performed such that the back surface of an exterior wall board 4 is in contact with the ridge portions 61 on the exterior side.

Here, installation is carried out in the following order.

First, the angular corrugated metal backing material 6 is fixed to horizontal members 8 serving as a structural building frame.

Next, in order to install the lowermost exterior wall board 4, a starter or the first fastening member 30 is fixed to the angular corrugated metal backing material 6 in a position below the lowermost exterior wall board 4.

Next, exterior wall boards 4 are sequentially installed from the left hand side of a building. Here, for the purposes of positioning and prevention of movement of the exterior wall boards 4, the lateral displacement preventing member 50 is fixed to the first fastening member 30 or the first fastening member 30 and the angular corrugated metal backing material 6 via the lower screw holes 59 or the upper screw holes 58 and the lower screw holes 59.

However, there are cases where a fixing member that is fixing the first fastening member 30 to the angular corrugated metal backing material 6 may interfere with fixing of the lateral displacement preventing member 50 to the first fastening member 30.

For this reason, in order to avoid a situation in which the lateral displacement preventing member 50 cannot be attached due to a fixing member that is fixing the first fastening member 30 to the angular corrugated metal backing material 6, three or more upper screw holes 58 and, furthermore, three or more lower screw holes 59 are formed in the lateral displacement preventing member 50.

In addition, an arrangement interval 91 of the upper screw holes 58 and an arrangement interval 92 of the lower screw holes 59 in the horizontal direction of the lateral displacement preventing member 50 are shorter than the length, in the width direction, of the ribs 61 on the exterior side of the angular corrugated metal backing material 6 on which the upper fixing plate 53 abuts.

Here, working examples of an installation structure in which exterior wall boards 4 are installed to the angular corrugated metal backing material 6 with the first fastening member 30 and the lateral displacement preventing member 50 will be described with reference to FIGS. 7A and 7B and FIGS. 8A and 8B.

Figure 7:
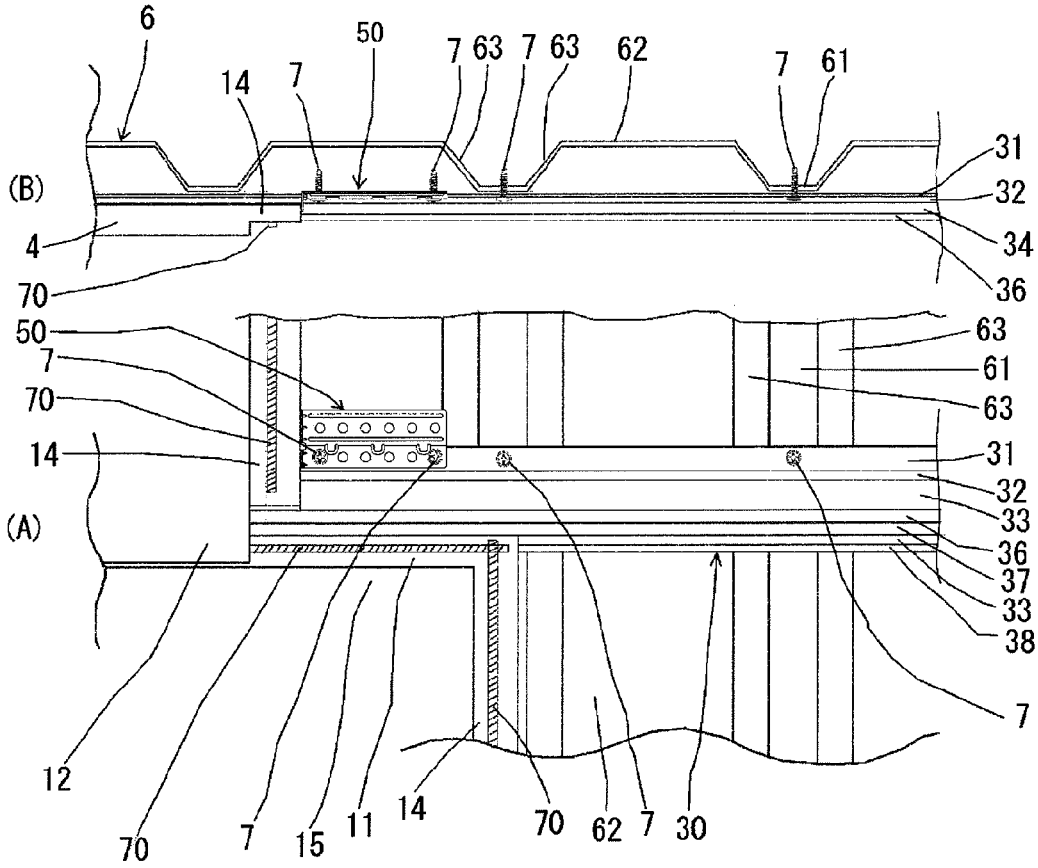
FIGS. 7A and 7B are a front view and a plan view, respectively, of an exterior wall installation structure according to Working Example 1.

Working Example 1 is an example in which no fixing member 7 for the first fastening member 30 hinders fixing of the lateral displacement preventing member 50, and as shown in FIGS. 7A and 7B, the lateral displacement preventing member 50 is fixed to the first fastening member 30 by the fixing members 7 via lower screw holes 59 on opposite ends thereof.

Therefore, it is not necessary to remove and attach the fixing members 7 for the first fastening member 30.

Working Example 2 is an example in which a fixing member 7 for the first fastening member 30 and the lateral displacement preventing member 50 overlap, and the fixing member 7 for the first fastening member 30 hinders fixing of the lateral displacement preventing member 50.

Figure 8:
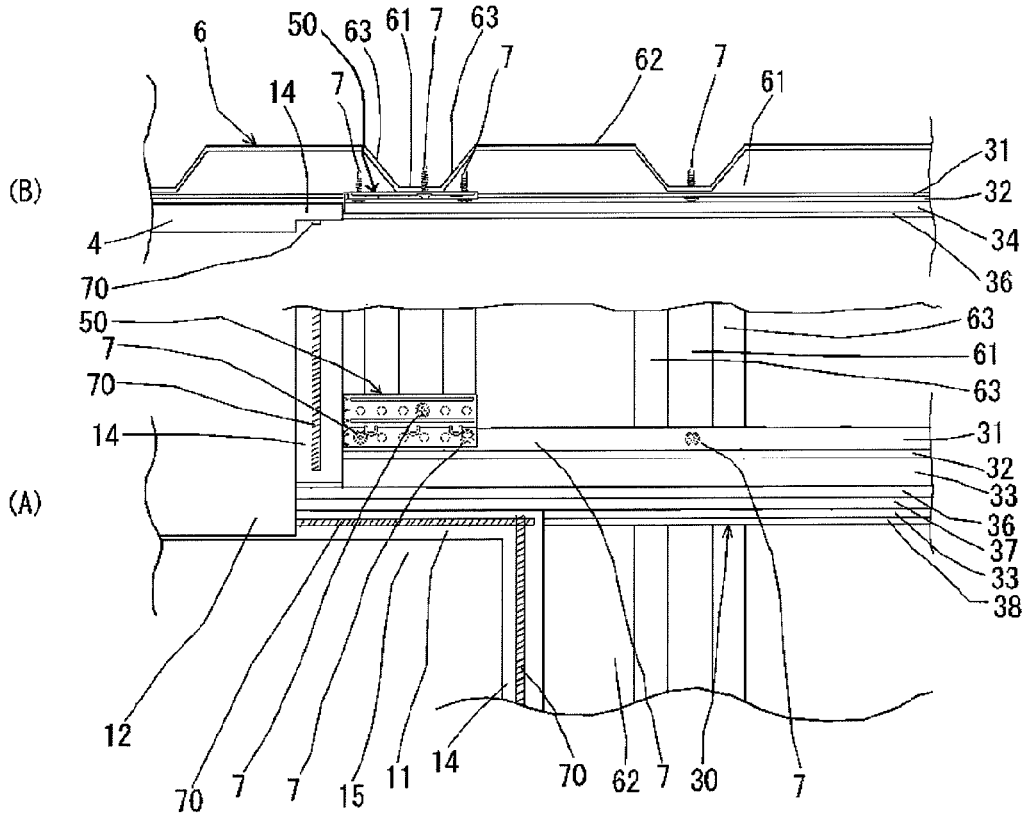
FIGS. 8A and 8B are a front view and a plan view, respectively, of an exterior wall installation structure according to Working Example 2.
Figure 9:
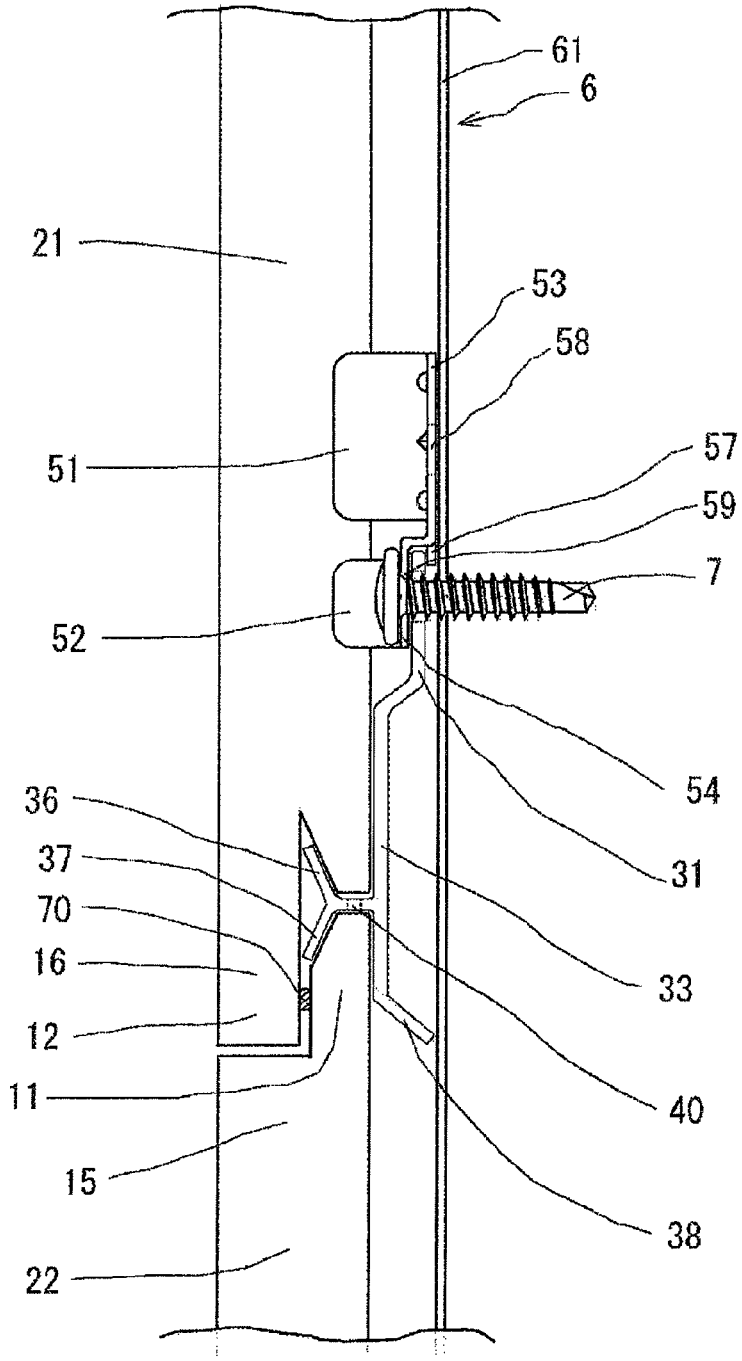
FIG. 9 is a vertical cross-sectional view showing the vicinity of a vertical joint portion of the exterior wall installation structure according to Working Example 1.
Figure 10:
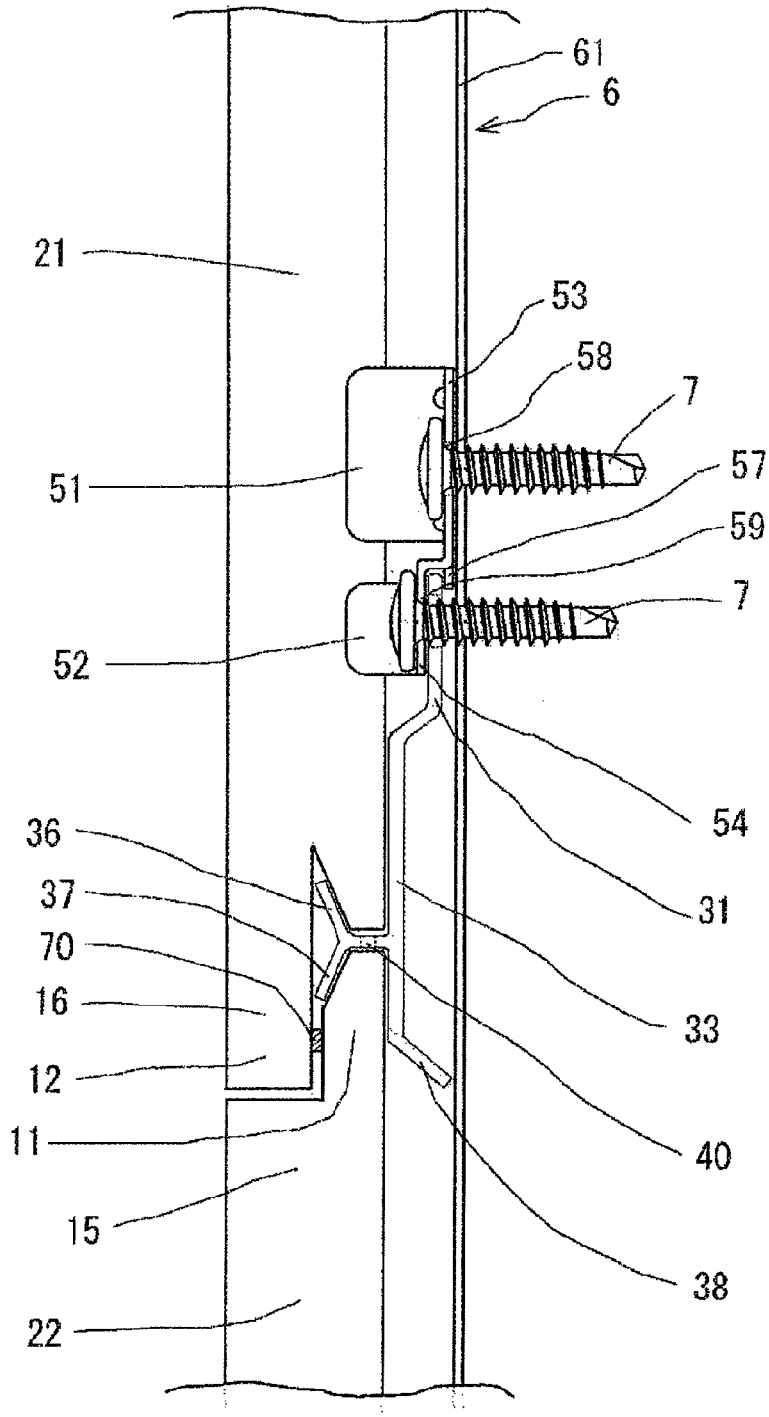
FIG. 10 is a vertical cross-sectional view showing the vicinity of a vertical joint portion of the exterior wall installation structure according to Working Example 2.
Figure 11:
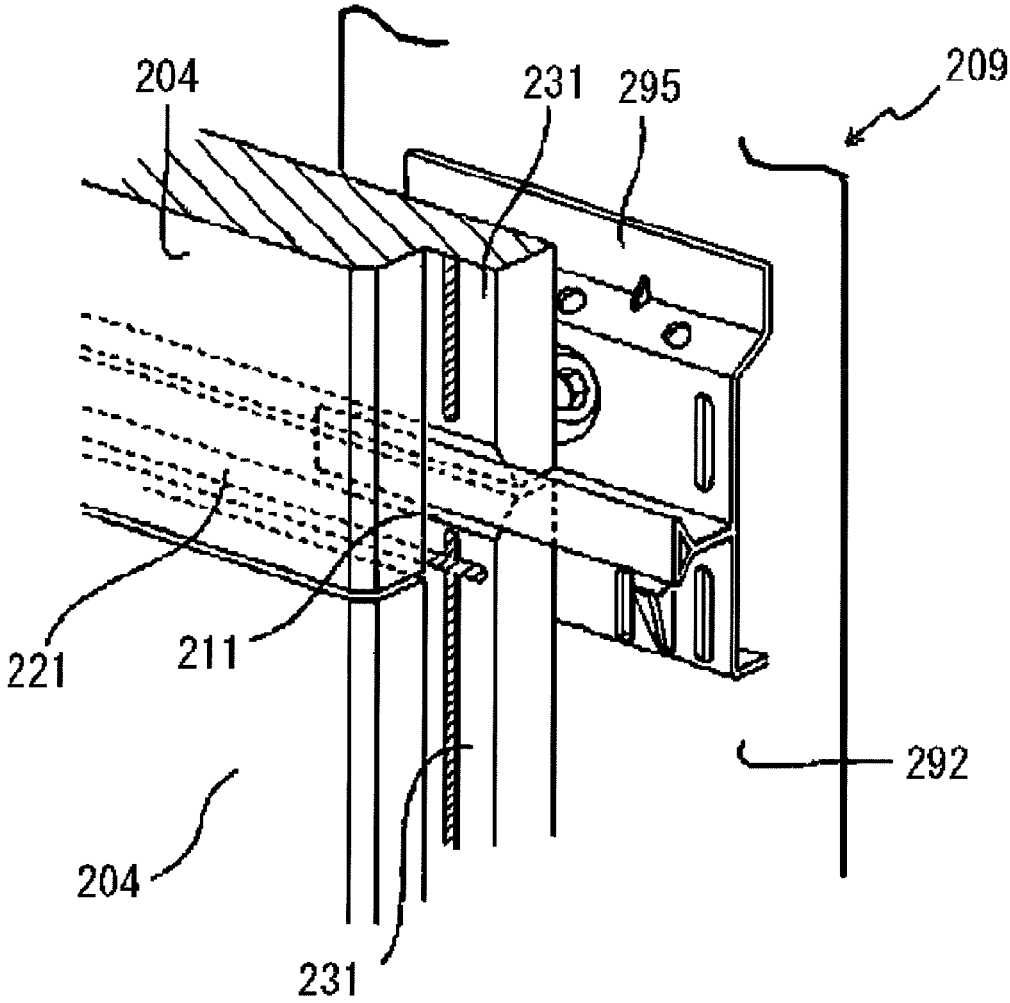
PRIOR ART FIG.11
FIG. 11 is a perspective view showing the vicinity of a vertical and horizontal joint portion of an exterior wall installation structure of a conventional example.
Figure 12:
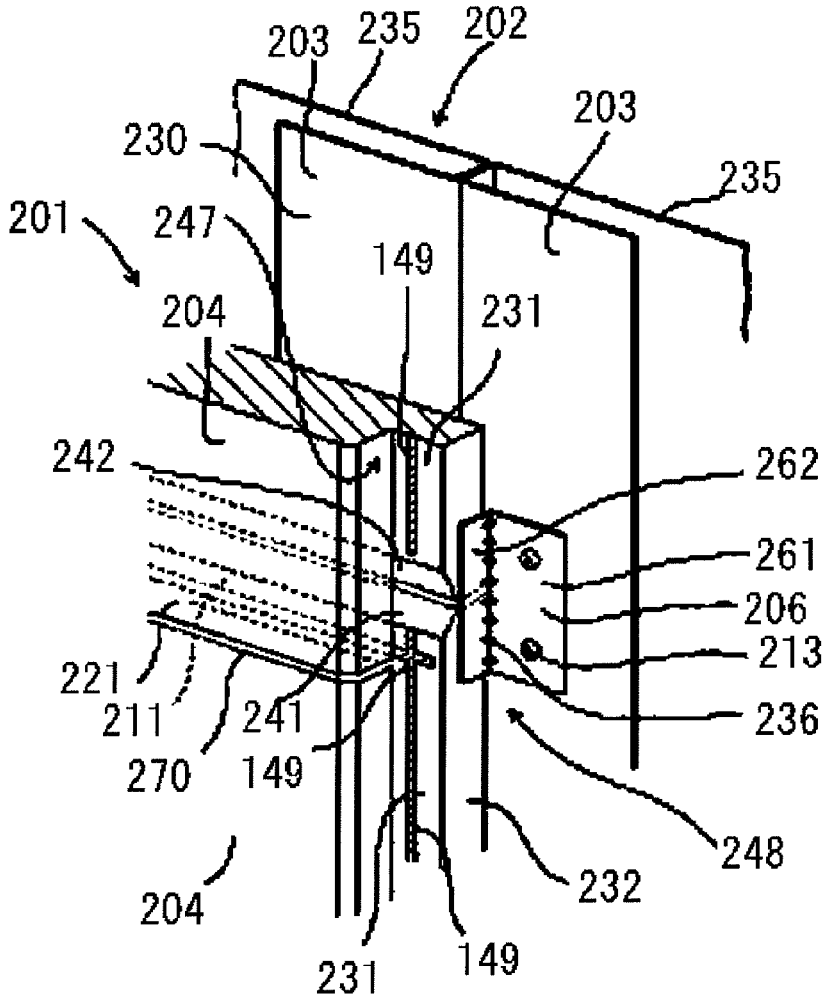
PRIOR ART FIG.12
FIG. 12 is a perspective view of an exterior wall installation structure of a conventional example.
Figure 13:
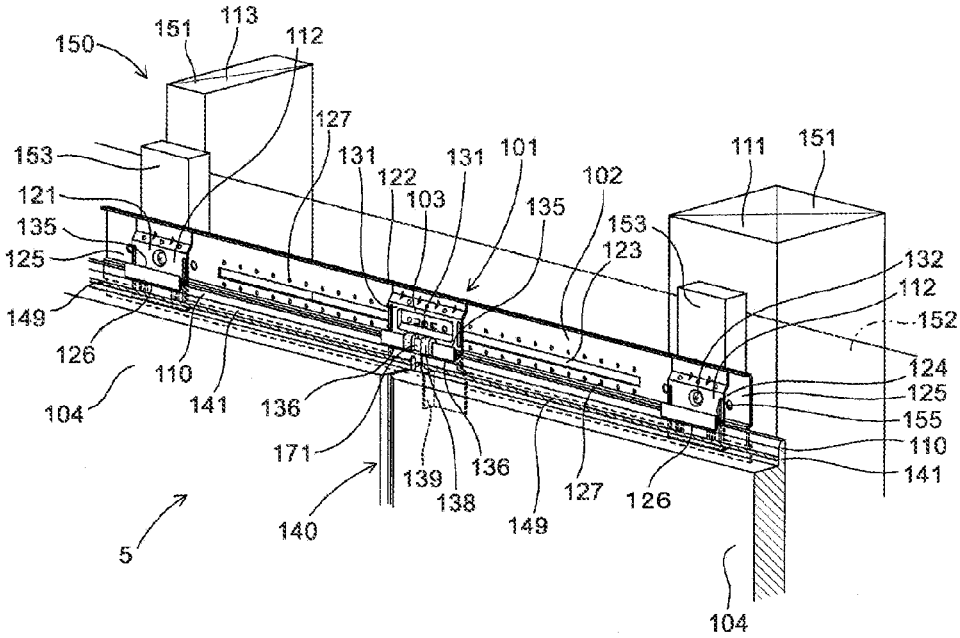
PRIOR ART FIG.13
FIG. 13 is a perspective view of an exterior wall installation structure of a conventional example.
Figure 14:
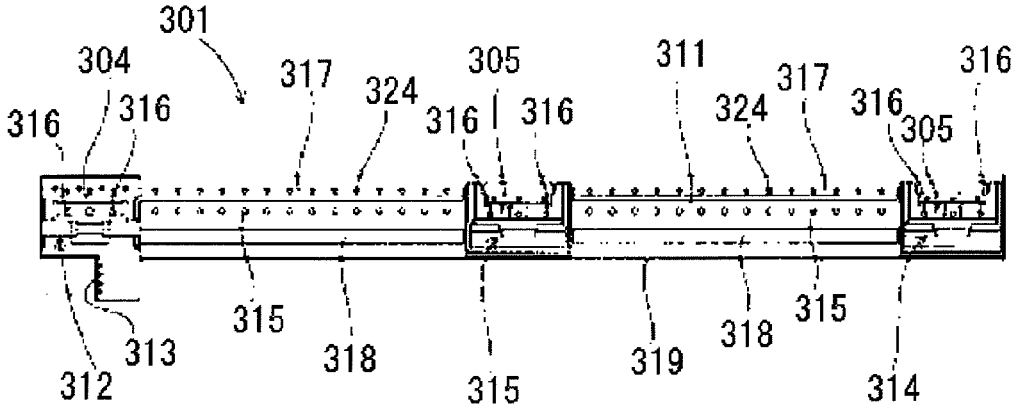
PRIOR ART FIG.14
FIG. 14 is a front view of a fastening member of a conventional example.

In this case, the fixing member 7 that is fixing the first fastening member 30 to the angular corrugated metal backing material 6 will be removed, and thus, as shown in FIGS. 8A and 8B, the lateral displacement preventing member 50 is fixed to the first fastening member 30 by fixing members 7 via the lower screw holes 59 on opposite ends thereof, and the lateral displacement preventing member 50 is further fixed to the angular corrugated metal backing material 6 via an upper screw hole 58.

Therefore, although the fixing member 7 that fixed the first fastening member 30 to the angular corrugated metal backing material 6 has been removed, the first fastening member 30 is fixed to the angular corrugated metal backing material 6 through the lateral displacement preventing member 50.

In Working Examples 1 and 2, the lateral displacement preventing member 50 is fixed to the first fastening member 30 by the fixing members 7 via the lower screw holes 59 on opposite ends thereof. However, in the case where there is an inclined portion 63 of the angular corrugated metal backing material 6 in a position at which a fixing member 7 is to be attached, the fixing member 7 may not be perpendicularly inserted. In order to avoid this situation, it is preferable to fix the lateral displacement preventing member 50 to the first fastening member 30 or the angular corrugated metal backing material 6 using a lower screw hole 59 or an upper screw hole 58 other than the lower screw holes 59 on opposite ends.

According to the present invention, the lateral displacement preventing member 50 can be freely disposed with respect to the lateral direction of the exterior wall boards 4 irrespective of the position of the ridge portions 61 on the exterior side of the angular corrugated metal backing material 6.

Therefore, with the lateral displacement preventing member 50, even when a horizontal joint portion of adjacent exterior wall boards 4 that are fastened to the angular corrugated metal backing material 6 while being joined together by shiplap joint on four sides is disposed in a position at which no ridge portion 61 on the exterior side of the angular corrugated metal backing material 6 is present, the lateral displacement preventing member 50 can be freely attached to the angular corrugated metal backing material 6 directly or via the first fastening member 30.

What is claimed is:

1. A lateral displacement preventing member that can be disposed in a horizontal joint portion of exterior wall boards that are fastened to an angular corrugated metal backing material while being joined together by shiplap joint on four sides and that is used to prevent lateral displacement of the exterior wall boards, the lateral displacement preventing member comprising:

a flat plate-like upper fixing plate;

an upper abutment plate that is provided upright at approximately right angles to the upper fixing plate;

a lower fixing plate that is extended from a lower end of the upper fixing plate and disposed approximately parallel to the upper fixing plate in a position forward of the upper fixing plate; and a lower abutment plate that is provided upright at approximately right angles to the lower fixing plate, wherein a back-side locking piece that extends from the lower end of the upper fixing plate downward and parallel to the lower fixing plate is provided, and when the lateral displacement preventing member is disposed in the horizontal joint portion, an upper horizontal portion of a first fastening member that is disposed in a vertical joint portion of the exterior wall boards is inserted between the back-side locking piece and the lower fixing plate.

2. The lateral displacement preventing member according to claim 1, wherein a plurality of upper screw holes are formed in the upper fixing plate in a horizontal direction, a plurality of lower screw holes are formed in the lower fixing plate in the horizontal direction, and arrangement intervals of the upper screw holes and of the lower screw holes in the horizontal direction are shorter than a length, in a width direction, of a ridge portion on an exterior side of the angular corrugated metal backing material on which the upper fixing plate abuts.

3. An exterior wall installation structure in which a plurality of exterior wall boards each having an upper underlying rabbeted portion, a lower overlying rabbeted portion, a lateral underlying rabbeted portion, and a lateral overlying rabbeted portion are fastened to an angular corrugated metal backing material while being joined together by shiplap joint on four sides, wherein the exterior wall boards are fastened to the angular corrugated metal backing material by a first fastening member disposed at an upper end portion and a lower end portion of the exterior wall boards, the first fastening member comprises an upper horizontal portion that forms a fixing surface to be fixed to the angular corrugated metal backing material, a flat plate portion that protrudes forward from the upper horizontal portion, a support portion that is provided upright across the entire lateral width of the flat plate portion so as to extend in a direction orthogonal to the flat plate portion, an upper locking piece that is bent obliquely upward from the support portion, and a lower locking piece that is bent obliquely downward from the support portion, the upper end portion of an exterior wall board that is disposed on a lower side is locked by the lower locking piece, the lower end portion of an exterior wall board that is disposed on an upper side is supported by the support portion and locked by the upper locking piece, and the upper horizontal portion is fixed to the angular corrugated metal backing material by a fixing member, a lateral displacement preventing member for preventing lateral displacement of the exterior wall boards is disposed in a horizontal joint portion of the exterior wall boards, the lateral displacement preventing member comprises a flat plate-like upper fixing plate, an upper abutment plate that is provided upright at approximately right angles to the upper fixing plate, a lower fixing plate that is extended from a lower end of the upper fixing plate and disposed approximately parallel to the upper fixing plate in a position forward of the upper fixing plate, a lower abutment plate that is provided upright at approximately right angles to the lower fixing plate, and a back-side locking piece that extends from the lower end of the upper fixing plate downward and parallel to the lower fixing plate, and the lower fixing plate is fixed to the first fastening member with a fixing member while the upper abutment plate and the lower abutment plate abut on a side end face of the exterior wall boards in a state in which the upper horizontal portion of the first fastening member is inserted between the back-side locking piece and the lower fixing plate.

4. The exterior wall installation structure according to claim 3, wherein, in the lateral displacement preventing member, a plurality of upper screw holes are formed in the upper fixing plate in a horizontal direction, a plurality of lower screw holes are formed in the lower fixing plate in the horizontal direction, and arrangement intervals of the upper screw holes and of the lower screw holes in the horizontal direction are shorter than a length, in a width direction, of a ridge portion on an exterior side of the angular corrugated metal backing material on which the upper fixing plate abuts.

5. The exterior wall installation structure according to claim 4, wherein the upper fixing plate is fixed to the angular corrugated metal backing material by one or more fixing members inserted through corresponding one or more of the upper screw holes.

* * * * *